United States Patent [19]

Chung et al.

[11] Patent Number: 4,512,872

[45] **Date of Patent: * Apr. 23, 1985**

[54] PROCESS FOR EXTRACTING BITUMEN FROM TAR SANDS

[75] Inventors: Harold S. Chung, Dallas, Tex.; Joseph J. Dickert, Jr., Yardley, Pa.

[73] Assignee: Mobil Oil Corporation, New York, N.Y.

[ * ] Notice: The portion of the term of this patent subsequent to Jul. 3, 2001 has been disclaimed.

[21] Appl. No.: 580,927

[22] Filed: Feb. 16, 1984

Related U.S. Application Data

[63] Continuation of Ser. No. 495,568, May 18, 1983, Pat. No. 4,457,827, which is a continuation-in-part of Ser. No. 242,217, Mar. 10, 1981, abandoned.

[51] Int. Cl.[3] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS

| | | | |
|---|---|---|---|
| 3,070,541 | 12/1962 | Price | 208/11 LE |
| 3,362,473 | 1/1968 | Foster | 166/273 |
| 3,553,049 | 1/1971 | Savage et al. | 208/11 LE |
| 4,067,796 | 1/1978 | Alford et al. | 208/11 LE |
| 4,068,716 | 1/1978 | Allen | 166/272 |
| 4,071,433 | 1/1978 | Hanson | 208/11 LE |
| 4,105,570 | 8/1978 | Stournas et al. | 166/273 |
| 4,291,765 | 9/1981 | Gilchrist et al. | 166/273 |
| 4,457,827 | 7/1984 | Chung et al. | 208/11 LE |

*Primary Examiner*—Delbert E. Gantz
*Assistant Examiner*—A. Pal
*Attorney, Agent, or Firm*—Alexander J. McKillop; Michael G. Gilman; Stanislaus Aksman

[57] ABSTRACT

This invention provides a process for the recovery of bitumen from mined tar sands that comprises admixing mined tar sands with a hydrocarbon liquid such as light crude oil or a mixture of light crude oils from a nearby reservoir thereby obtaining a bitumen-hydrocarbon mixture mixed with sand, separating the bulk of said bitumen-hydrocarbon mixture from the sand as a liquid, and recovering the remainder of the bitumen-hydrocarbon mixture using chemical waterflooding techniques.

9 Claims, 1 Drawing Figure

PROCESS FOR EXTRACTING BITUMEN FROM TAR SANDS

CROSS-REFERENCE TO RELATED APPLICATIONS

This application is a continuation of copending U.S. application Ser. No. 495,568, filed May 18, 1983, now U.S. Pat. No. 4,457,827 of July 3, 1984, which is, in turn, continuation-in-part of copending U.S. application Ser. No. 242,217, filed Mar. 10, 1981, now abandoned the entire disclosures of which are expressly incorporated herein by reference.

BACKGROUND

This invention is concerned with the extraction of bitumen from tar sands.

Approximately 30 billion barrels of tar sand bitumen in Athabasca (out of 625 billion barrels in Alberta) and part of 26 billion barrels in Utah are accessible to mining. The mined sands are now commercially processed for bitumen recovery by the "Clark Hot Water" method. In the Athabasca region, it has been estimated that, at most, two additional plants of the 125,000 bpd size can make use of this recovery technique; this restriction stems from severe environmental constraints such as high water and energy consumption and tailings disposal. Two alternate bitumen recovery methods are being pursued: thermal treatment (e.g., retorting) and extraction with solvents. Both have high energy requirements; the first—poor sensible heat recovery and the burning of part of the resources, and the second—solvent-bitumen separation and solvent loss through incomplete steam stripping. Shortcomings of these approaches are minimized by the present process. Finally, Utah tar sand and mineable resources in the Athabasca region are both recoverable by this method.

SUMMARY

According to one aspect of the invention, there is provided a process for the recovery of bitumen from mined tar sands that comprises the steps of:

(i) admixing mined tar sands with a liquid hydrocarbon which is miscible with the bitumen in said tar sands, whereby a portion of said miscible liquid hydrocarbon becomes dissolved in at least a portion of said bitumen, thereby becoming absorbed on said tar sand and reducing the viscosity of the bitumen remaining thereon;

(ii) essentially separating the mixture of step (i) into a liquid hydrocarbon portion and a solid tar sand portion, said solid tar sand portion containing bitumen of reduced viscosity; and (iii) while maintaining said separated tar sand portion of step (ii) in an essentially fixed bed state in one or more columns, injecting into one end of said column or columns an aqueous chemical waterflooding composition comprising water and at least one chemical waterflooding additive selected from the group consisting of surfactants, viscosifying additives and mixtures thereof, whereby said waterflooding composition passes through said column or columns in a manner such that the tar sands in said column are maintained in a fixed bed state with the substantial absence of agitation of the tar sand particles and bitumen on said tar sand is displaced therefrom and is passed along with said waterflooding composition to the end of said column or columns opposite the point of injection.

According to another aspect of the invention, there is provided a process for the recovery of bitumen from mined tar sands that comprises the steps of:

(i) admixing mined tar sands with a light crude oil or a mixture of light crude oils, whereby a portion of the bitumen is dissolved in said crude oil or oils and a portion of said crude oil or oils is dissolved in bitumen remaining on said tar sands, thereby becoming absorbed on said tar sands and reducing the viscosity of the bitumen remaining thereon;

(ii) essentially separating the mixture of step (i) into a liquid portion constituting crude oil or oils and dissolved bitumen and a solid portion constituting tar sands containing thereon bitumen and dissolved crude oil or oils;

(iii) forming a fixed bed of the solid portion of step (ii); and (iv) passing an aqueous surfactant composition through said fixed bed of step (iii), whereby said surfactant composition passes through said fixed bed in a manner such that the substantial absence of agitation of tar sand particles is maintained and bitumen on said tar sands is displaced therefrom and is passed along with said surfactant composition through and out of said bed.

DETAILED DESCRIPTION

Figure 1:
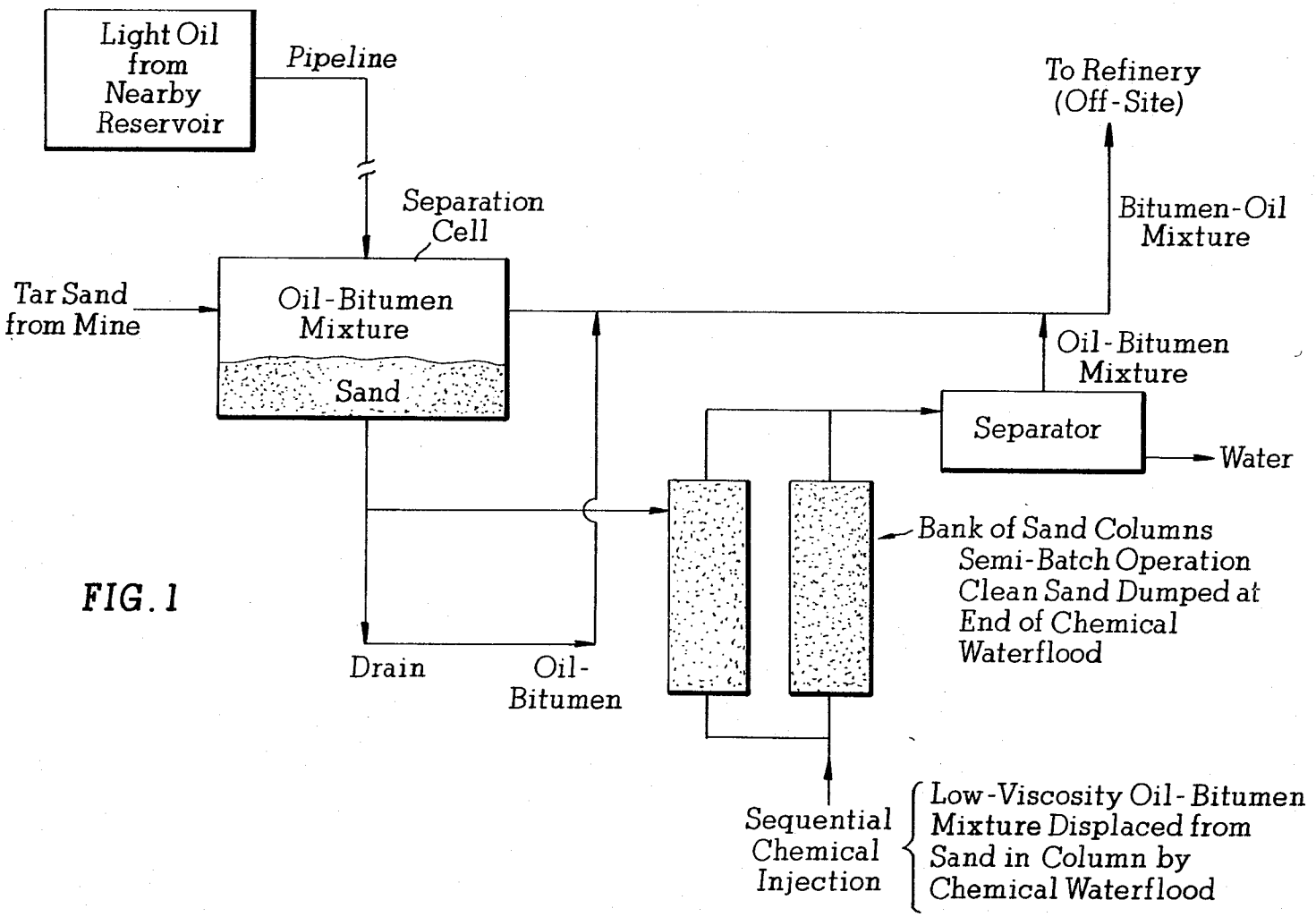
FIG. 1 is a self-explanatory diagrammatic representation of an example of a process for recovering bitumen from tar sands according to the present invention.

It will be understood that when tar sands are separated from liquid according to separation step (ii) described herein, the separation need not be entirely complete. More particularly, a certain residual amount of liquid hydrocarbon may be tolerated on the tar sands after this separation step. Accordingly, the step of separating tar sands from liquid hydrocarbons may be characterized as a step of essentially separating these liquid and solid elements of the mixture.

The tar sands may be maintained in a fixed bed state for contact with the chemical waterflooding composition by any convenient means. For example, the tar sands may be first packed in columns prior to contact with liquid hydrocarbon. According to this embodiment, contact with both liquid hydrocarbon and chemical waterflooding composition could take place in the same column. More preferably, however, contact of tar sands with liquid hydrocarbon may take place in an agitated vessel. The hydrocarbon treated tar sands may then be transferred to one or more columns by any convenient means. For example, a tar sand liquid hydrocarbon mixture may be introduced into columns as a slurry, and the tar sands permitted to settle with the excess liquid hydrocarbon being removed by decantation or draining.

The volume of chemical waterflooding fluid which is introduced into the fixed bed of tar sands may be; e.g., from about 10 to about 100% of the volume of the fixed bed. This chemical waterflooding fluid is preferably followed by a sufficient quantity of a drive fluid and may be preceded by a water wash slug, e.g., a slug containing essentially no chemical waterflooding compositions.

The hydrocarbon liquid and the chemical waterflood fluid may be essentially unheated, each having a temperature of, e.g., 50° C. or less.

The hydrocarbon liquid for contact with the mined tar sands is selected in kind and amount such that bitumen is not totally dissolved in the liquid hydrocarbon phase of the liquid hydrocarbon/tar sand mixture. To the contrary, at least a portion of the liquid hydrocarbon becomes dissolved in the viscous bitumen, thereby becoming adsorbed onto the tar sands and decreasing the viscosity of the bitumen remaining thereon. Therefore, the liquid hydrocarbon need not be a relatively expensive solvent such as kerosene. More particularly, the liquid hydrocarbon may even be an unrefined hydrocarbon such as crude oil, most especially, a light crude oil or a mixture of light crude oils.

The light crude oil or mixture of light crude oils may be obtained from a nearby oil field or reservoir. In the case of the Athabasca tar sands in Alberta, Canada, for example, the light crude oil can be obtained from the Pembina Field (1.05 cp at reservoir temperature of 125° F.) or from the Carson Creek reservoir (Beaver Hill Lake Field, N.W. of Edmonton, as even lighter crude oil). The light crude oil and bitumen in tar sand are mutually miscible. Accordingly, when light crude oil and tar sands are admixed, there is obtained a bitumen-light oil mixture having much reduced viscosity and easy flowability. The amount of light crude oil required is dependent upon its viscosity and the viscosity of the bitumen in the tar sand to be treated. It is readily determinable in each case. Large amounts of light crude oil are not required, however, to attain drastic viscosity reduction of the bitumen.

The bulk, i.e., most of the bitumen-hydrocarbon liquid mixture, can be readily separated from the sand. Any known physical separation process can be used such as drainage, decantation, and the like. Steam stripping is unnecessary.

The remaining fraction of the bitumen-hydrocarbon fraction, intimately associated with the sand, requires further treatment for hydrocarbon recovery. For this purpose, it is feasible to remove the sand remaining after the bulk of the bitumen-hydrocarbon mixture has been separated to a batch of sand columns operated semi-batchwise. The columns are flooded with chemical waterflood fluids that are well known in the art. Such chemical waterflooding fluids may contain surfactants and/or mobility control agents such as polymers. For typical disclosures of such fluids, reference is made to W. R. Foster, "A Low-Tension Waterflooding Process," *Journal of Petroleum Technology*, Vol. 25, February 1973, pp. 205–210 and to U.S. Pat. Nos. 3,308,883; 3,362,473; 4,105,570 and 4,120,801. Generally, use is contemplated of low salinity petroleum sulfonate based formulations, as well as brine-tolerant formulations, in cases where multivalent cations and salt contents of the matrix are high. The aqueous chemical waterflooding fluid may be, e.g., in the form of a solution or a microemulsion containing a small amount (e.g., from about 3 to about 20% by weight) of an oil additive. Clean sand may be dumped at the end of the chemical waterfood.

The bitumen-hydrocarbon mixtures from the initial (bulk) separation and from the chemical, waterflood separation may be combined and can be used as such as a refinery feed.

Several advantages are evident in aspects of this invention according to which embodiments thereof are contemplated:

1. The light oil and/or mixture of light crude oils partially serves as a solvent; however, it does not need to be recovered as such. It can be sold as a refinery feed, thus eliminating a most serious disadvantage of solvent-based bitumen recovery processes in tar sand exploitation.

2. The products will flow through pipelines. Therefore, no on-site upgrading (an expensive part of current commercial tar sands exploitation) would be required.

3. In the most proposed solvent-based processes, thermal methods (e.g., steam stripping) are used for solvent recovery. These thermal methods are expensive and in most instances recovery is incomplete due to the high molecular weight and low volatility of the bitumen-solvent association. The chemical waterflood process should yield little or no slime since the clay fines would not be thoroughly conditioned in base such as sodium carbonate or sodium hydroxide solution nor violently agitated as in the current "Clark Hot Water" process. Thus, no slime ponds for tailing disposal and no high energy consumption solvent stripping are needed.

4. The energy requirement of this integrated process should be much lower than the "Clark Hot Water" process or experimental processes based on retorting and further thermal treatment.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A process for the recovery of bitumen from mined tar sands that comprises the steps of:

(i) admixing mined tar sands with a liquid hydrocarbon which is miscible with the bitumen in said tar sands, whereby a portion of said miscible liquid hydrocarbon becomes dissolved in at least a portion of said bitumen, thereby becoming absorbed on said tar sand and reducing the viscosity of the bitumen remaining thereon;

(ii) essentially separating the mixture of step (i) into a liquid hydrocarbon portion and a solid tar sand portion, said solid tar sand portion containing bitumen of reduced viscosity; and (iii) while maintaining said separated tar sand portion of step (ii) in an essentially fixed bed state in one or more columns, injecting into one end of said column or columns an aqueous chemical waterflooding composition comprising water and at least one chemical waterflooding additive selected from the group consisting of surfactants, viscosifying additives and mixtures thereof, whereby said waterflooding composition passes through said column or columns in a manner such that the tar sands in said column or columns are maintained in a fixed bed state with the substantial absence of agitation of the tar sand particles, and bitumen on said tar sand is displaced therefrom and is passed along with said waterflooding composition to the end of said column or columns opposite the point of injection.

2. A process according to claim 1, wherein a portion of the bitumen on the tar sand is dissolved in said liquid hydrocarbon in step (i) and is separated along with said liquid hydrocarbon portion in step (ii).

3. A process according to claim 2, which does not involve conditioning of said mined tar sand with a base.

4. A process according to claim 3, which does not involve conditioning of said mined tar sand with sodium hydroxide or sodium carbonate.

5. A process according to claim 4, wherein said viscosifying additives are polymers.

6. A process according to claim 5, wherein said chemical waterflooding additive is a petroleum sulfonate surfactant.

7. A process according to claim 6, wherein said aqueous chemical waterflooding composition is injected as a slug having a volume of from about 10 to 100% of the volume of the bed of tar sands packed in said column or columns, and wherein said slug is followed by the injection of a sufficient volume of a drive fluid to drive said slug completely through said column or columns.

8. A process according to claim 7, wherein said drive fluid contains a mobility control agent.

9. A process according to claim 7, wherein said chemical waterflooding slug is preceded by an aqueous slug essentially free of surfactant or viscosifying additive.

* * * * *